US011933124B2

(12) United States Patent
Deocampo

(10) Patent No.: US 11,933,124 B2
(45) Date of Patent: Mar. 19, 2024

(54) OIL FIELD TOOL LATCH SYSTEM AND METHOD

(71) Applicant: FALCONVIEW ENERGY PRODUCTS LLC, Houston, TX (US)

(72) Inventor: Hernani G. Deocampo, Houston, TX (US)

(73) Assignee: FALCONVIEW ENERGY PRODUCTS LLC, Houston, TX (US)

( * ) Notice: Subject to any disclaimer, the term of this patent is extended or adjusted under 35 U.S.C. 154(b) by 3 days.

(21) Appl. No.: 17/533,953

(22) Filed: Nov. 23, 2021

(65) Prior Publication Data

US 2023/0160273 A1 May 25, 2023

(51) Int. Cl.
*E21B 23/02* (2006.01)

(52) U.S. Cl.
CPC ..... *E21B 23/02* (2013.01)

(58) Field of Classification Search
CPC ..... E21B 23/02
See application file for complete search history.

(56) References Cited

U.S. PATENT DOCUMENTS 3,678,998 A 7/1972 Cockrell et al.
3,710,859 A * 1/1973 Hanes ..... E21B 43/013 166/347
3,749,166 A 7/1973 Young
3,944,273 A 3/1976 Ahlstone
3,972,546 A 8/1976 Putch
4,408,783 A * 10/1983 Gruller ..... E21B 33/043 285/321
4,657,083 A * 4/1987 Ringgenberg ..... E21B 34/103 166/324
4,836,288 A * 6/1989 Wester ..... E21B 33/043 166/341
4,898,245 A 2/1990 Braddick
5,174,376 A 12/1992 Singeetham
5,433,269 A 7/1995 Hendrickson
5,637,037 A * 6/1997 Bergquist ..... B24B 3/60 451/450
5,727,632 A 3/1998 Richards
6,520,263 B2 * 2/2003 June ..... E21B 33/043 166/88.1

(Continued)

FOREIGN PATENT DOCUMENTS

GB 2573314 A 11/2019

*Primary Examiner* — Jonathan Malikasim
(74) *Attorney, Agent, or Firm* — Jackson Walker LLP

(57) ABSTRACT

The present disclosure provides a latch system that is activated internally after installation in a tubular member and requires no external penetration through a wall of the tubular member. The latch system and the tool on which it is installed includes an energizing ring and a lock ring resting on a portion of the tool, where the energizing ring can be pressed toward the lock ring to expand the lock ring radially outward and lock into an internal lock groove in a bore of the tubular member. A self-locking mechanism using corresponding profiles in the components can, with the lock ring expansion, longitudinally lock the energizing ring with the lock ring and lock the energizing ring with the tubular member. The dual locking of the three components locks or otherwise restrains the components together, so that the tool is fixed in a longitudinal position relative to the tubular member.

8 Claims, 10 Drawing Sheets

(56) References Cited

U.S. PATENT DOCUMENTS

| | | | | |
|---|---|---|---|---|
| 8,186,446 | B2 | 5/2012 | Ingram et al. | |
| 9,388,655 | B2 | 7/2016 | Sommerfeld et al. | |
| 9,810,034 | B2 | 11/2017 | Pray et al. | |
| 9,822,601 | B2 | 11/2017 | Nguyen et al. | |
| 10,538,989 | B2 * | 1/2020 | Merron | E21B 47/26 |
| 10,927,626 | B2 * | 2/2021 | Nguyen | E21B 23/02 |
| 2021/0332662 | A1 * | 10/2021 | Gissler | F16J 15/08 |

* cited by examiner

OIL FIELD TOOL LATCH SYSTEM AND METHOD

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The disclosure generally relates to an apparatus and method for securing a tool in a tubular member. More specifically, the disclosure relates a latch system that can removably secure an oil field tool in a casing, wellhead, or other tubular member.

Description of the Related Art

The oil and gas industry ubiquitously installs tools into tubular members, such as casings, production tubing, and wellheads, to perform operations. Typically, the tools need longitudinal securing within the tubular members to withstand differential pressures between uphole and downhole portions of a wellbore.

FIG. 1 is a schematic cross sectional view of a typical wellhead with a casing hanger securing a casing inside a larger casing. A wellhead 2 is generally located above a wellbore and supports equipment downhole and at the surface. In this illustration, a large first casing 4 has been installed to a certain depth and is constrained upwardly by the wellhead 2. A small second casing 6 is installed within the bore of the larger casing and suspended from the wellhead by a casing hanger 8. A void area between an inner periphery of the large first casing 4 and the outer periphery of the small second casing 6 forms an annulus 18 that can be pressurized from downhole pressures that extend into the void area between the inner periphery of the wellhead and the outer periphery of the second casing. The casing hanger 8 is installed in an annulus 20 between the wellhead bore and the smaller casing in communication with the annulus 18. A seal (not shown) can be installed above the casing hanger to seal off wellbore pressures in the annulus 18. The casing hanger 8 is supported vertically by a shoulder 10 in the wellhead inner periphery and restrained from upward movement by a set of lockdown screws 12. The lockdown screws 12 are spaced around an outside periphery of the wellhead and extend through holes 14 in the wellhead wall to extend into the bore of the wellhead. When tightened against the casing hanger 8, a lockdown screw form a restraining surface 16 that engages the casing hanger and limits upward movement of the casing hanger.

While such a system is widely used in the oil field industry and other industries, a disadvantage can be the piercing of the wellhead wall, which functions as a pressure vessel to contain wellbore pressures often of 10,000 psi to 20,000 psi. For example, there may be eight or more lockdown screws and therefore eight or more holes that must be sealed through the wellhead wall against such pressures. Further, each lockdown screw needs to be installed to securely engage the casing hanger. Such an operation costs time and expense as a lost opportunity for other operations.

Therefore, there remains an improved latching method and system to secure a tool in a tubular member, such as a wellhead, casing, or other tubular member.

BRIEF SUMMARY OF THE INVENTION

The present disclosure provides a latch system that is activated internally after installation in a tubular member and requires no external penetration through a wall of the tubular member. The latch system and the tool on which it is installed includes an energizing ring and a lock ring resting on a portion of the tool, where the energizing ring can be pressed toward the lock ring to expand the lock ring radially outward and lock into an internal lock groove in a bore of the tubular member. A self-locking mechanism using corresponding profiles in the components can, with the lock ring expansion, longitudinally lock the energizing ring with the lock ring and lock the energizing ring with the tubular member. The dual locking of the three components locks or otherwise restrains the components together, so that the tool is fixed in a longitudinal position relative to the tubular member.

The internal latch system offers technical and operational advantages, including: minimizing leak paths through pressure vessels in which the latch system is installed; simplifying operation and installation of tools such as "bowl protector", providing uniform and symmetrical contact on the lock ring against a tubular member, and requiring no external seal through a tubular member wall compared to a typical lockdown screw.

The disclosure provides an oil field tool configured to be secured inside a tubular member, comprising: a housing; and a latch system coupled with the housing, the latch system comprising: a lock ring coupled around a periphery of the housing and having a self-locking engagement profile on an inside periphery of the lock ring; and an energizing sleeve slidably coupled around the housing and longitudinally displaceable relative to the lock ring and having a self-locking engagement profile on an outside periphery of the energizing sleeve configured to engage with the lock ring self-locking engagement profile and restrain relative longitudinal movement between the lock ring and energizing sleeve.

The disclosure also provides a method of an oil field tool configured to be secured inside a tubular member, comprising: a housing; and a latch system coupled with the housing, the latch system comprising: a radially expandable lock ring coupled around a periphery of the housing and formed with slits through a longitudinal portion that is less than a longitudinal length of the ring; and an energizing sleeve slidably coupled around the housing and longitudinally displaceable relative to the lock ring.

DETAILED DESCRIPTION

Figure 1:
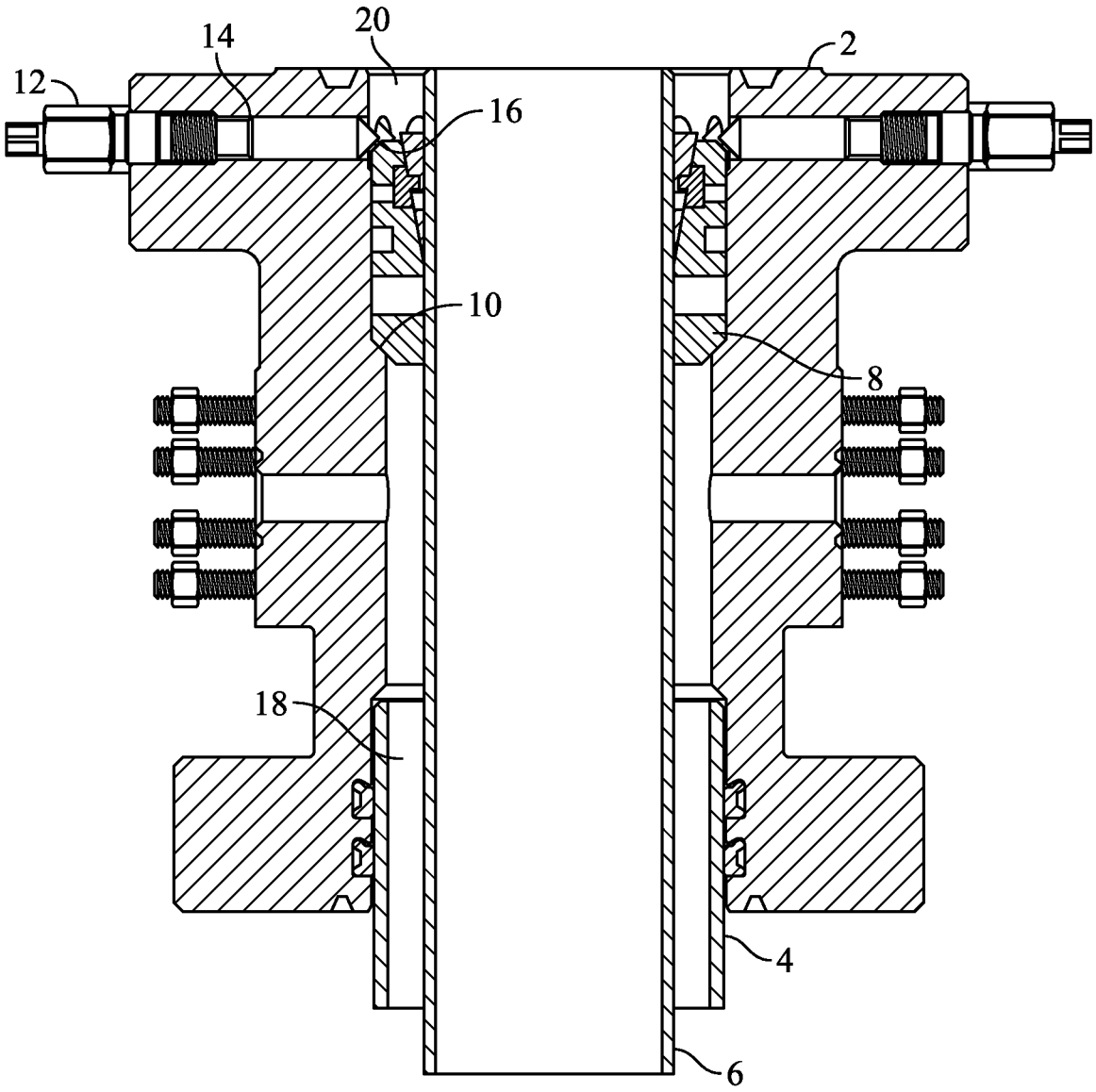
FIG. 1 (Prior Art)
FIG. 1 is a schematic cross sectional view of a typical wellhead with a casing hanger securing a casing inside a larger casing.

The Figures described above and the written description of specific structures and functions below are not presented to limit the scope of what Applicant has invented or the scope of the appended claims. Rather, the Figures and written description are provided to teach any person skilled in the art how to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location, or with time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Further, the various methods and embodiments of the system can be included in combination with each other to produce variations of the disclosed methods and embodiments. Discussion of singular elements can include plural elements and vice-versa. References to at least one item may include one or more items. Also, various aspects of the embodiments could be used in conjunction with each other to accomplish the understood goals of the disclosure. Unless the context requires otherwise, the term "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The terms "top", "up", "upward", "bottom", "down", "downwardly", and like directional terms are used to indicate the direction relative to the figures and their illustrated orientation and are not absolute relative to a fixed datum such as the earth in commercial use. The term "inner," "inward," "internal" or like terms refers to a direction facing toward a center portion of an assembly or component, such as longitudinal centerline of the assembly or component, and the term "outer," "outward," "external" or like terms refers to a direction facing away from the center portion of an assembly or component. The term "coupled," "coupling," "coupler," and like terms are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unitary fashion. The coupling may occur in any direction, including rotationally. The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions. Some elements are nominated by a device name for simplicity and would be understood to include a system of related components that are known to those with ordinary skill in the art and may not be specifically described. Various examples are provided in the description and figures that perform various functions and are non-limiting in shape, size, description, but serve as illustrative structures that can be varied as would be known to one with ordinary skill in the art given the teachings contained herein. As such, the use of the term "exemplary" is the adjective form of the noun "example" and likewise refers to an illustrative structure, and not necessarily a preferred embodiment. Element numbers with suffix letters, such as "A", "B", and so forth, are to designate different elements within a group of like elements having a similar structure or function, and corresponding element numbers without the letters are to generally refer to one or more of the like elements. Any element numbers in the claims that correspond to elements disclosed in the application are illustrative and not exclusive, as several embodiments may be disclosed that use various element numbers for like elements.

The present disclosure provides a latch system that is activated internally after installation in a tubular member and requires no external penetration through a wall of the tubular member. The latch system and the tool on which it is installed includes an energizing ring and a lock ring resting on a portion of the tool, where the energizing ring can be pressed toward the lock ring to expand the lock ring radially outward and lock into an internal lock groove in a bore of the tubular member. A self-locking mechanism using corresponding profiles in the components can, with the lock ring expansion, longitudinally lock the energizing ring with the lock ring and lock the energizing ring with the tubular member. The dual locking of the three components locks or otherwise restrains the components together, so that the tool is fixed in a longitudinal position relative to the tubular member.

Figure 2A:
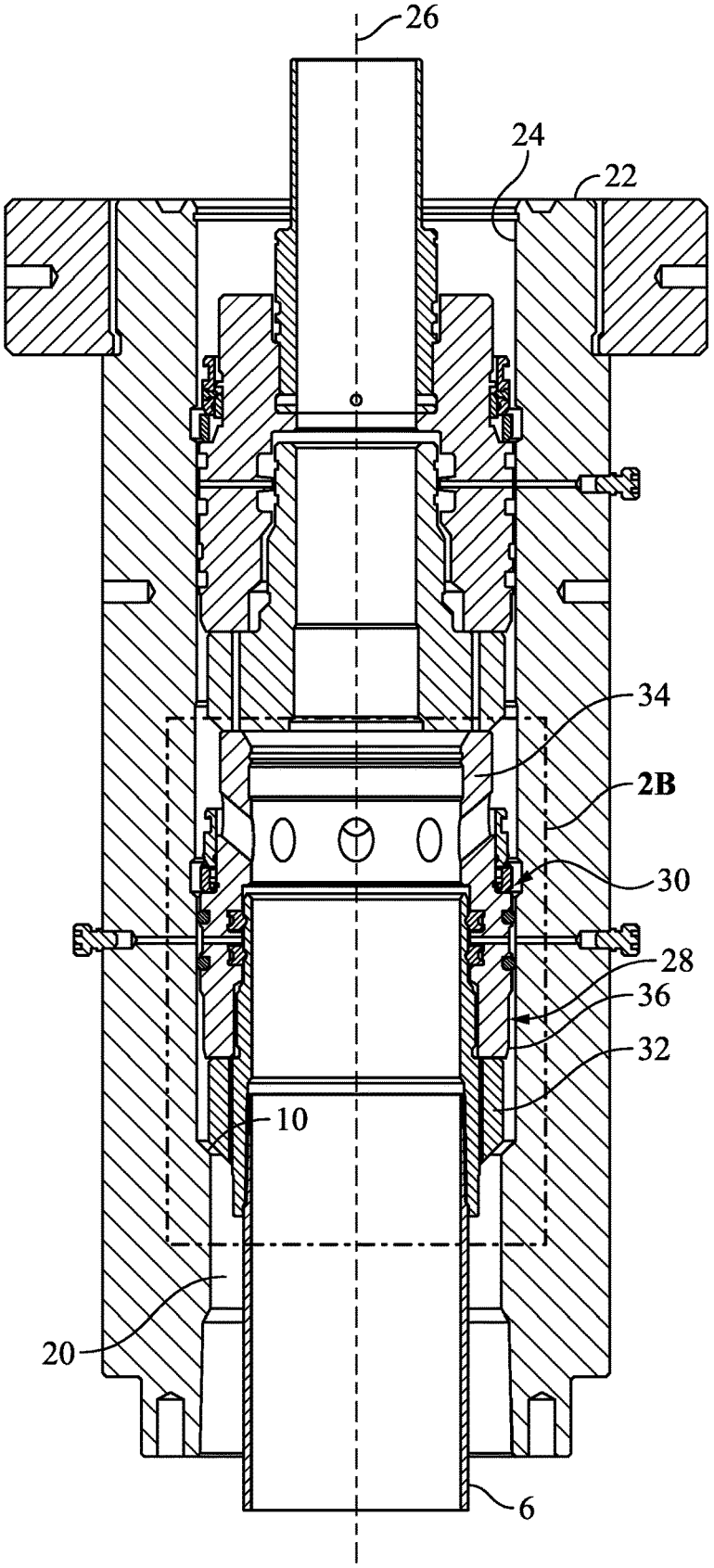
FIG. 2A is a schematic cross sectional view of an embodiment of a latch system according to the invention for a tool installed in a tubular member, such as a wellhead.
Figure 2B:
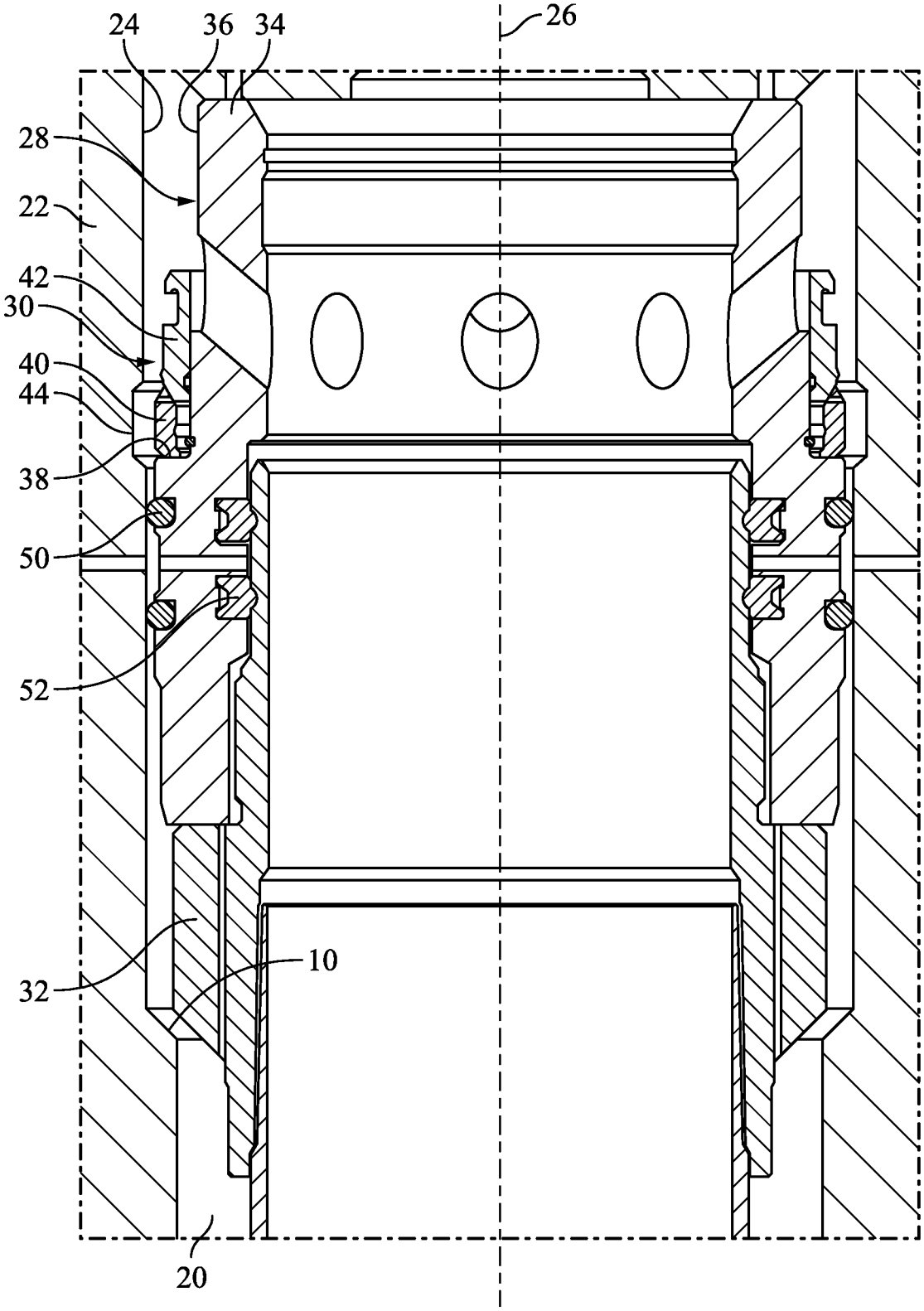
FIG. 2B is a schematic cross sectional view of an enlarged portion of the tool and latch system of FIG. 2A.

FIG. 2A is a schematic cross sectional view of an embodiment of a latch system according to the invention for a tool installed in a tubular member, such as a wellhead. FIG. 2B is a schematic cross sectional view of an enlarged portion of the tool and latch system of FIG. 2A. A tubular member 22, such as a wellhead, has a bore forming an inner periphery 24 with a longitudinal axis 26. A casing 6 such as described in FIG. 1 can form an annulus 20 between the outer periphery of the casing and the inner periphery 24 of the tubular member 22. In this embodiment, a casing hanger 32 can be set in the tubular member and supported on a shoulder 10 described above. A tool 28, such as without limitation a pack-off and seal assembly, has at least one embodiment of a latch system 30, shown in this figure in a deactivated state. A housing 34 of the tool 28 can house various components, allow test pressure communication, and provide flow-by ports for drilling fluids and wellhead annulus pressure buildup. The tool 28 can be configured with thread profiles to engage a running tool and other delivery mechanisms to place the tool 28 in an appropriate location in a wellbore, allow disengagement of the running tool after placement, and possible later retrieval of the tool. The tool 28 can engage the casing hanger 32 and seal the annulus 20 with the latch system engaged between the tubular member inner periphery 24 and an outer periphery of the tool 28. Once latched, the tool 28 can restrain longitudinal movement of the casing hanger, which is generally an upward movement restraint in the orientation shown in the figures. Outer seals 50 on tool 28 can seal against the tubular member inner periphery 24, and inner seals 52 on tool 28 can seal against another tool, such as the casing hanger 32. The seals can be elastomeric seals and can rely on an interference between the opposing sealing surfaces to cause a pressure tight seal under. The seals 50 and 52 can prevent pressure migration from one annulus area to another to control and maintain well integrity.

More specifically, in at least this embodiment, the tool 28 can have a housing 34 with an outer periphery 36. A shoulder 38 can be formed on the outer periphery 36 to support the latch system 30. The latch system 30 includes a lock ring 40 and an energizing sleeve 42. The inner periphery 24 of the tubular member 22 has a lock groove 44 to receive the lock ring 40 when activated. In a deactivated state, the lock ring 40 can be supported by the shoulder 38. The energizing sleeve 42 can be longitudinally displaced along the longitudinal axis 26 from the lock ring 40. The displacement allows the lock ring 40 to compress inwardly toward the outer periphery 36 of the tool housing 34 to a minimum diameter allowed by the energizing sleeve 40. To facilitate relative movement between the surfaces of the lock ring 40 and the energizing sleeve 42, one or both of the surfaces may have a taper or other shapes to bias the components in a desired direction during activation.

Other tooling can be coupled uphole from the tool 28, not pertinent to the present disclosure. FIGS. 2A and 2B show an example of an embodiment in which a tool can use the latch assembly described herein. Other tools, other locations, and other purposes can use the latch system in the oil field installations and the embodiment is not limiting.

Figure 3A:
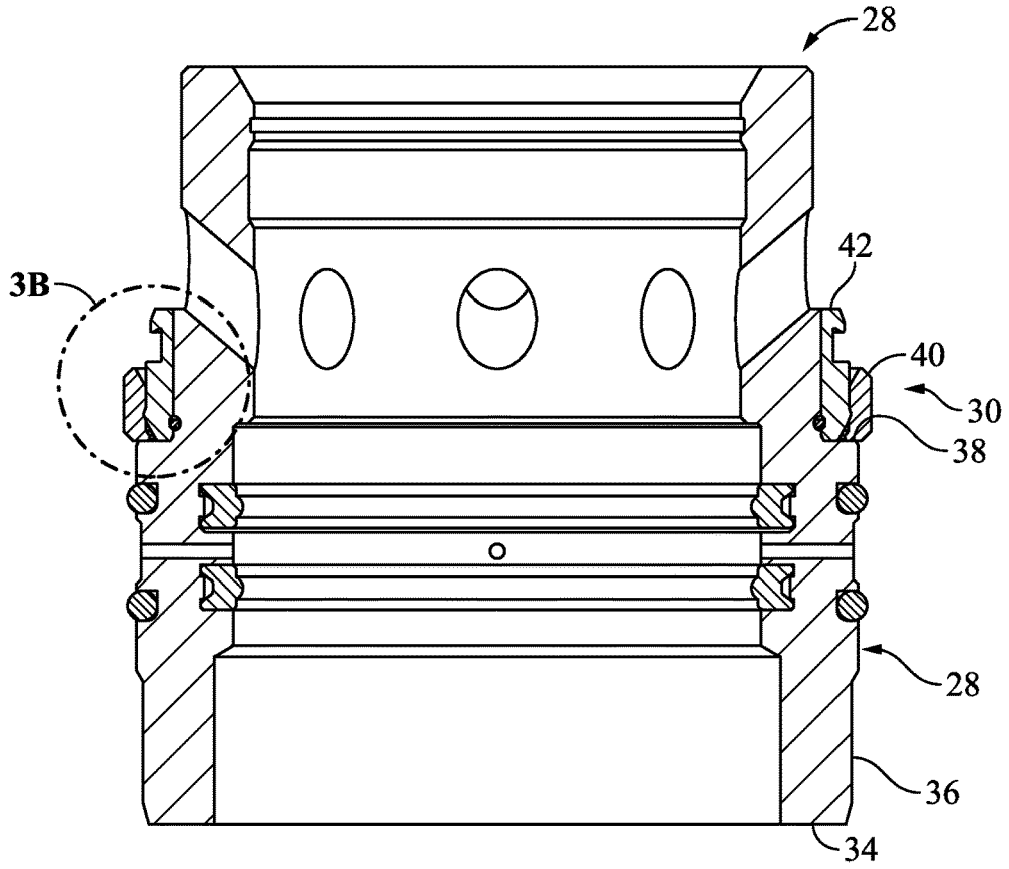
FIG. 3A is a schematic cross sectional view of the tool with the latch system energized.
Figure 3B:
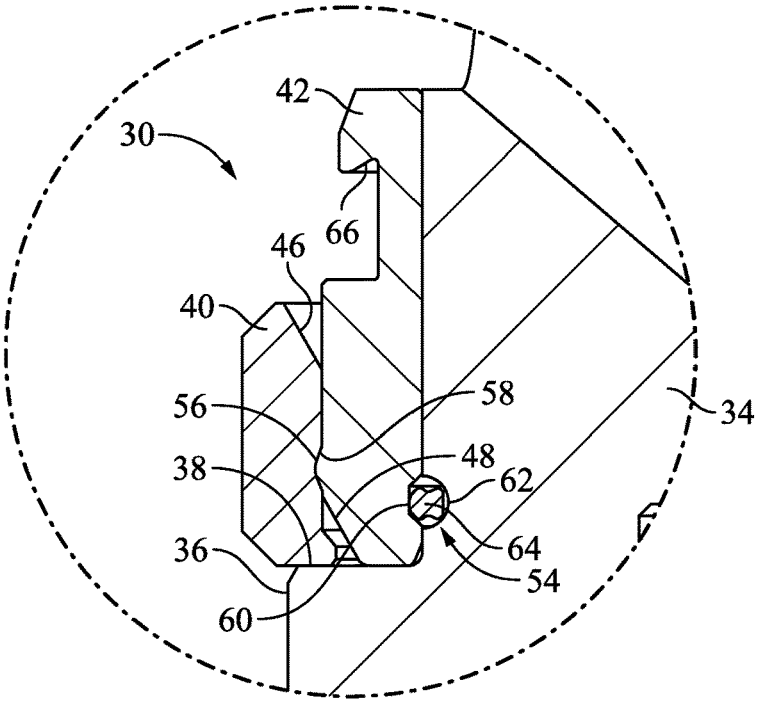
FIG. 3B is a schematic cross sectional view of an enlarged portion of the tool and latch system of FIG. 3A.
Figure 3C:
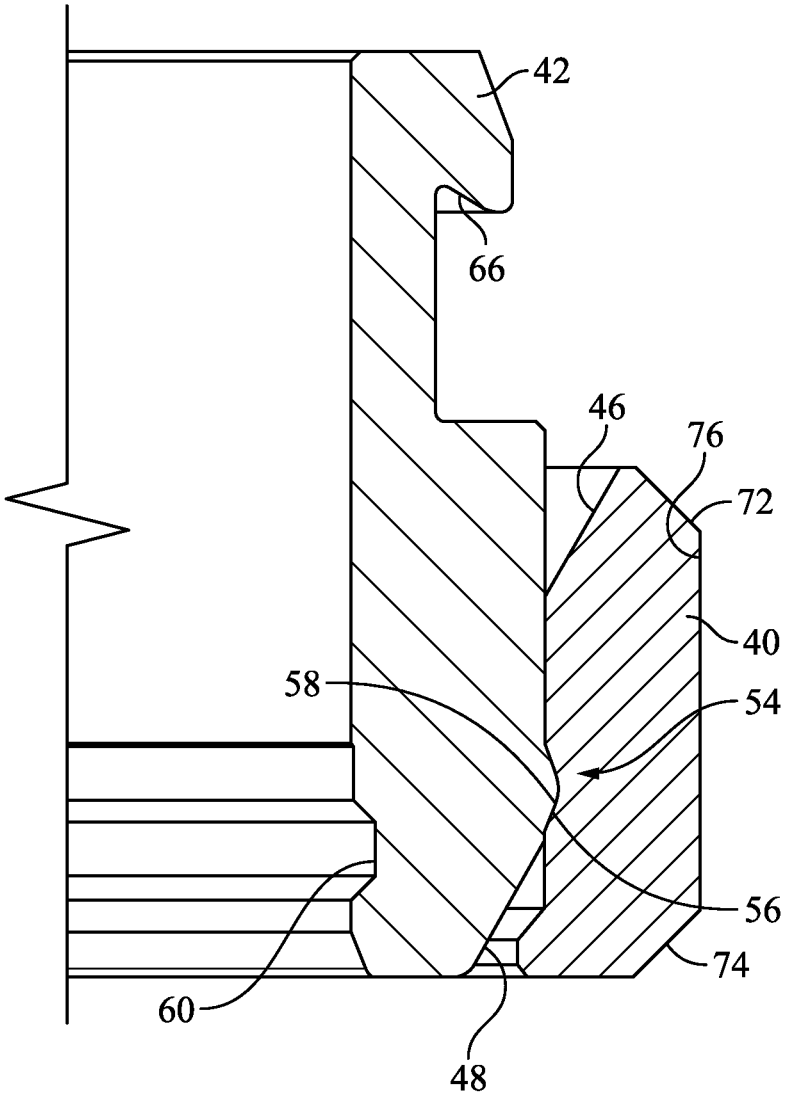
FIG. 3C is a schematic cross sectional enlarged view of the latch system of FIG. 3A illustrating at least one embodiment of self-locking engagement profiles.

FIG. 3A is a schematic cross sectional view of the tool with the latch system energized. FIG. 3B is a schematic cross sectional view of an enlarged portion of the tool and latch system of FIG. 3A. FIG. 3C is a schematic cross sectional enlarged view of the latch system of FIG. 3A illustrating at least one embodiment of self-locking engagement profiles. The tool housing 34 is shown with the energizing sleeve 42 longitudinally aligned with the lock ring 40 on the shoulder 38 compared to being longitudinally displaced from the lock ring and shoulder in FIGS. 2A and 2B. In this longitudinally aligned position, the energizing sleeve 42 exerts a radial force outwardly (away from the longitudinal axis 26) on the lock ring 40 that forces the lock ring toward the tubular member lock groove 44 to engage the lock groove, described above. A tapered surface 46 on the lock ring 40 can engage with a tapered surface 48 on the energizing sleeve 42 to facilitate moving the lock ring radially outwardly in opposition to the radial bias inwardly of the lock ring.

The latch system 30 features a self-locking mechanism 54 that is independent of typical lockdown screws such as shown in FIG. 1, requires no external actuation as the lockdown screws, and thus can avoids holes through the wall of the tubular member. The self-locking mechanism 54 can be actuated by the longitudinal movement of the energizing ring to activate the lock ring outwardly as described. In at least one embodiment, the self-locking mechanism 54 includes an outer self-locking engagement profile 58 on an outside periphery of the energizing sleeve 42 configured to engage with an inner self-locking engagement profile 56 on an inner periphery of the lock ring 40 and restrain relative longitudinal movement between the lock ring and energizing sleeve. In at least one embodiment, one of the self-locking engagement profiles can be a protrusion and another of the self-locking engagement profiles can be a groove that fits the protrusion.

The self-locking mechanism 54 can further have self-locking profiles between the energizing sleeve 42 and the tool housing 34. Therefore, the self-locking mechanism 54 can be considered a dual self-locking mechanism. The energizing sleeve 54 can have an inner self-locking engagement profile 60 and the tool housing 34 can have an outer self-locking engagement profile 62. In this embodiment, a compressible member 64 can be placed between the inner self-locking engagement profile 60 and the outer self-locking engagement profile 62 for longitudinally coupling the profiles. The amount of compressibility and therefore the resistance to decoupling (and coupling) can be varied by the stiffness of the member measured by its durometer. The durometer of the compressible member can be relatively high to provide a high degree of stiffness for coupling the energizing sleeve 42 with the tool housing 34. In practice, the compressible member 64 can be placed circumferentially around the outer self-locking engagement profile 62 of the tool housing 34 and so be present as the energizing sleeve 42 moves longitudinally along the tool housing to activate the lock ring 40. The energizing sleeve 42 can slide over the compressible member 64 to compress the member 64 radially into the tool housing outer self-locking engagement profile 62 until the energizing sleeve inner self-locking engagement profile 60 aligns with the tool housing outer self-locking engagement profile 62 and compression member 64 is at least partially released to fit into the inner self-locking engagement profile 60. When the compression member 64 is engaged in the inner self-locking engagement profile 60 and the tool housing outer self-locking engagement profile 62, the energizing sleeve 42 is restrained longitudinally with the tool housing 34.

Thus, the combination of the two sets of self-locking engagement profiles and compression member result in (1) a first portion of the self-locking mechanism 54 restraining the lock ring 40 with the energizing sleeve 42, and (2) a second portion of the self-locking mechanism 54 restraining the energizing sleeve 42 with the tool housing. The restraining of both sets of self-locking engagement profiles occurs in conjunction with the activation of the lock ring 40 into the tubular member lock groove 44. When the first portion of the self-locking mechanism is activated, then the lock ring 40 is activated into the tubular member lock groove 44, as described above. Thus, the tubular member 22 is restrained longitudinally with the tool housing 34. The restraint occurs independent of external lockdown screws and the external actions, other than those actions causing the energizing sleeve 42 to move longitudinally along the tool housing, such as with a running tool known in the art.

The lock ring 40 can also have a hook profile 66 facing radially outwardly from the tool housing 34. A running tool (not shown) can be configured to engage the hook profile 66 and pull the energizing sleeve 42 back into a longitudinally displaced position relative to the lock ring. Displacing the energizing sleeve longitudinally from the lock ring allows the lock ring 40 to return radially inward to a disengaged position from the tubular member 22. Displacing the energizing sleeve longitudinally also decouples the energizing sleeve 42 from the tool housing 34. The tool 28 can be retrieved from the installation location. For example, this decoupling may be necessary when the seals are damaged during installation and will not hold pressure during a pressure test.

Figure 4C:
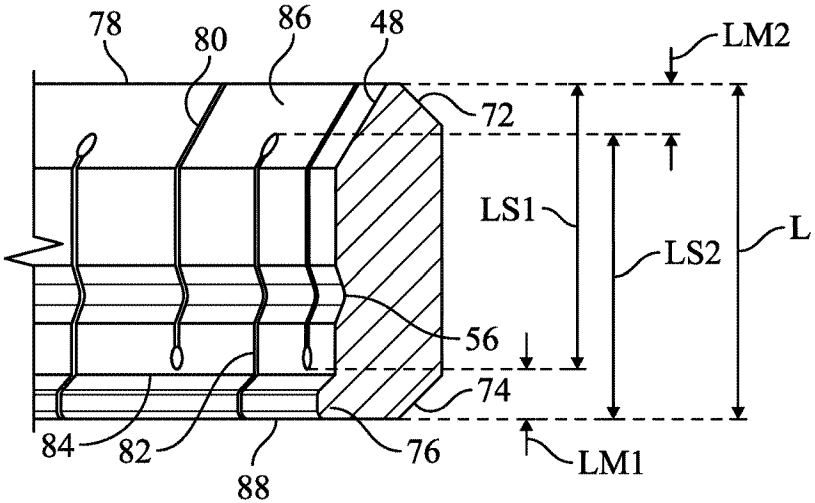
FIG. 4C is a schematic cross sectional view of the lock ring of FIG. 4A.
Figure 4D:
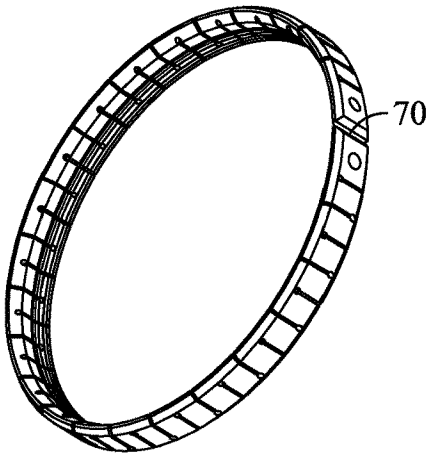
FIG. 4D is a schematic perspective view of the lock ring of FIG. 4A.
Figure 4B:
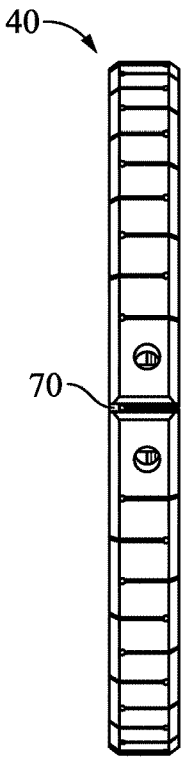
FIG. 4B is a schematic side view of the lock ring of FIG. 4A.
Figure 4A:
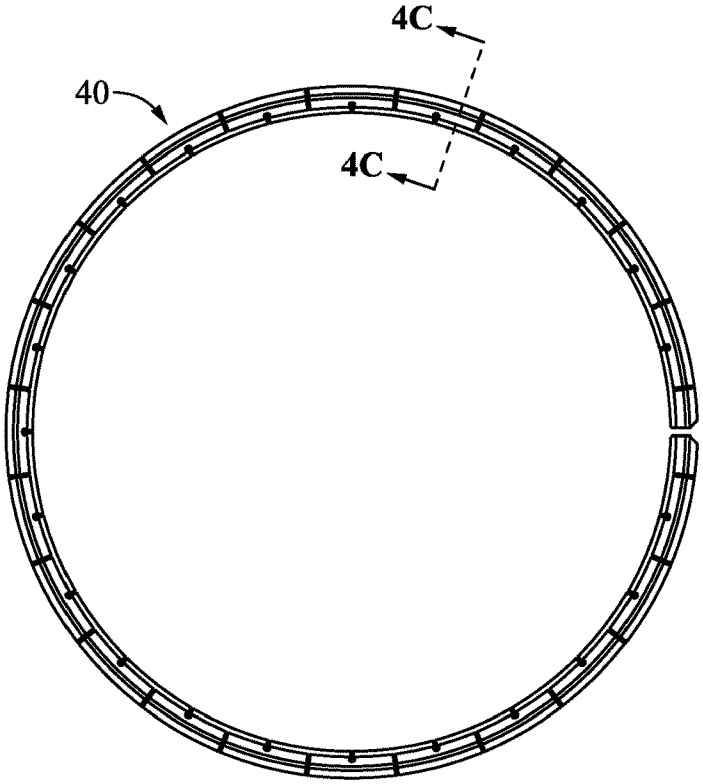
FIG. 4A is a schematic top view of an embodiment of a lock ring of the latch system.

FIG. 4A is a schematic top view of an embodiment of a lock ring of the latch system. FIG. 4B is a schematic side view of the lock ring of FIG. 4A. FIG. 4C is a schematic cross sectional view of the lock ring of FIG. 4A. FIG. 4D is a schematic perspective view of the lock ring of FIG. 4A. In at least one embodiment, the lock ring 40 can be a C-type configured ring having a split 70 entirely across the longitudinal cross-section to allow expansion and contraction of an effective diameter of the lock ring. The lock ring 40 can include the tapered surface 46 described above that can be engaged with the energizing sleeve tapered surface 48 on the energizing sleeve 42. Further, the lock ring 40 can include a first outer tapered surface 72 and a second outer tapered surface 74 on an outside periphery to facilitate engagement into the tubular member lock groove 44. The lock ring inner self-locking engagement profile 56, described above, is shown enlarged in FIG. 4C. In at least one embodiment, the profile 56 can be in the form of a groove to receive a corresponding protruding profile from the energizing sleeve 42. An inner projection 76 can be formed in the lock ring 40 to further restrict longitudinal movement relative to the energizing sleeve 42 when assembled on the tool housing 34 (shown above).

The strength of the lock ring 40 in resisting longitudinal movement of the tool 28 relative to the tubular member 22 is in the lock ring shear resistance in a longitudinal direction of its cross-section from the engagement of the lock ring into the tubular member lock groove 44. Thus, the radial expansion can advantageously be flexible, so that the lock ring 40 can be radially activated with a minimal amount of activation force from the energizing sleeve 42 when the lock ring is expanded to the locking position described above. To facilitate reducing a required activation force, the lock ring 40 can be partially split longitudinally across portions of its longitudinal length while leaving a portion that is not split. For example, a first split 80 can be formed in an upper portion 78 of the lock ring 40 for a length LS1 and leave a remaining material 84 having a length LM1 that is not split, so that the total length of LS1+LM1=L can be the length of the longitudinal cross-section of the lock ring. To allow a more uniform peripheral radial movement of the lock ring 40, a similar opposing second split 82, which is circumferentially offset from the first split, can be formed in a lower portion 88 of the lock ring 44 for a length LS2 and leave a remaining material LM2 that is not split, so that the total length of LS2+LM2=L. The opposing splits can be alternated around the circumference of the lock ring 40. The alternating sequence around the circumference assists in the lock ring expanding with less activation force in a more uniform manner that can maintain a longitudinal orientation of the lock ring cross section that is similar whether compressed or expanded.

Figure 5:
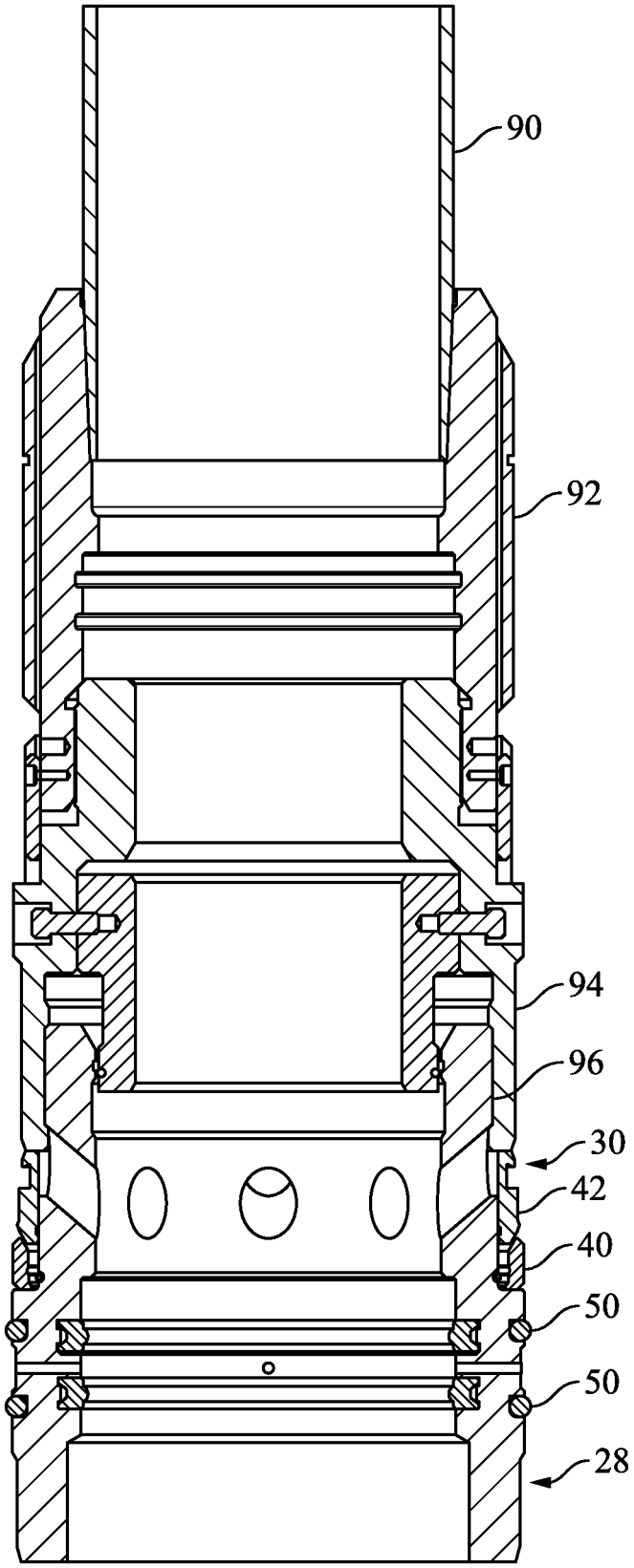
FIG. 5 is a schematic cross sectional view of an installation tool coupled with the tool having the latch system of FIG. 3A prior to installation and activation.

FIG. 5 is a schematic cross sectional view of an installation tool coupled with the tool having the latch system of FIG. 3A prior to installation and activation. The latch system 30 is shown in a retracted decoupled state on the tool 28. The tool 28 is ready for installation at a pre-determined location. In an example, a landing assembly of tubing 90 (such as casing) can be used to deliver the tool to the location. The landing assembly 90 can be coupled to a running tool 92 to assist in temporarily holding the tool 28 during delivery. An adapter 94 can be used to transition between the running tool 92 and the tool 28 and rotatably coupled with the running tool. In at least one embodiment, the landing assembly, running tool, adapter if used, and the tool 28 can be threaded together for delivery, and then reverse rotated to release the tool 28 at the location. If left-hand threads are used, the running tool with the adapter can be rotated counter-clockwise along a running thread on the tool 28 to engage the tool, while not so far as to press the energizing sleeve 42 longitudinally into the lock ring 40 to actuate the lock ring.

Figure 6:
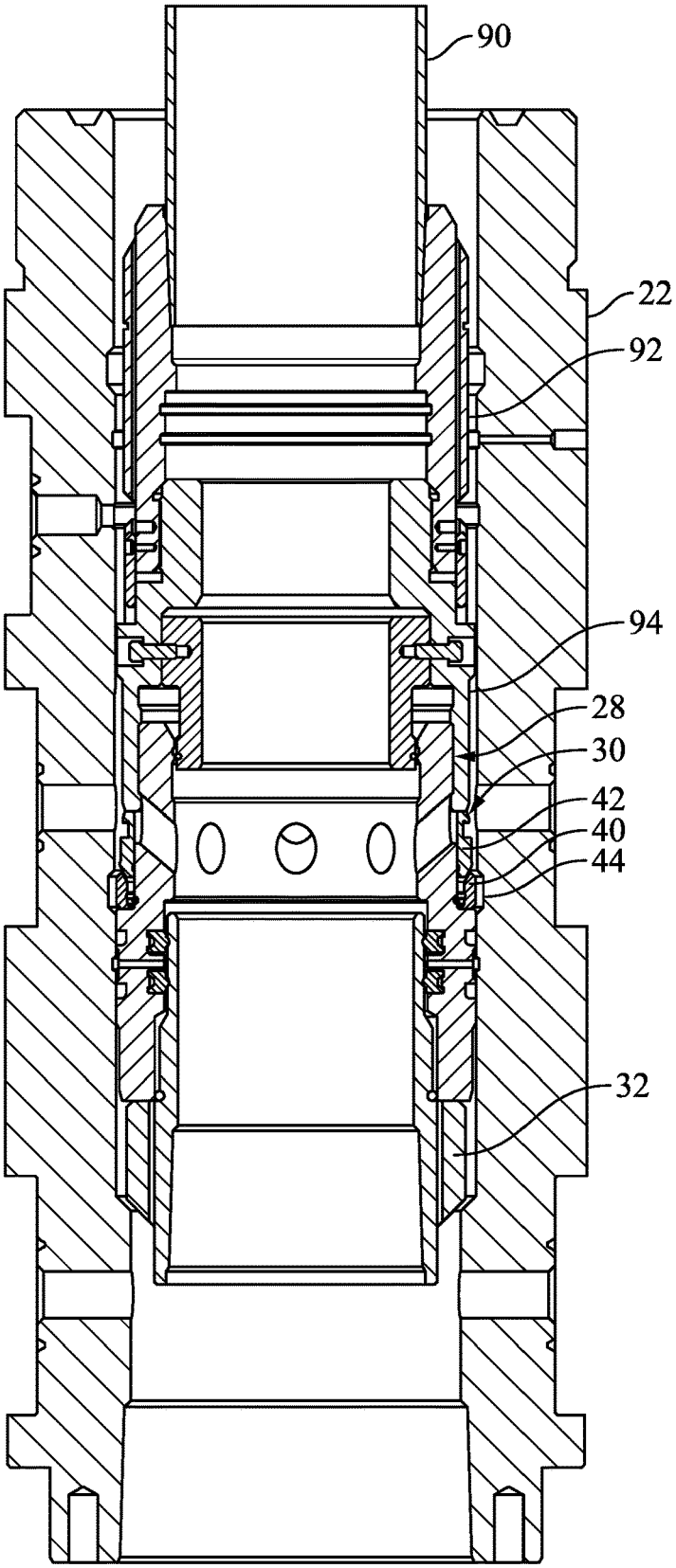
FIG. 6 is a schematic cross sectional view of the installation tool coupled with the tool having the latch system of FIG. 3A with the tool and latch system installed at location but prior to activation.
Figure 7A:
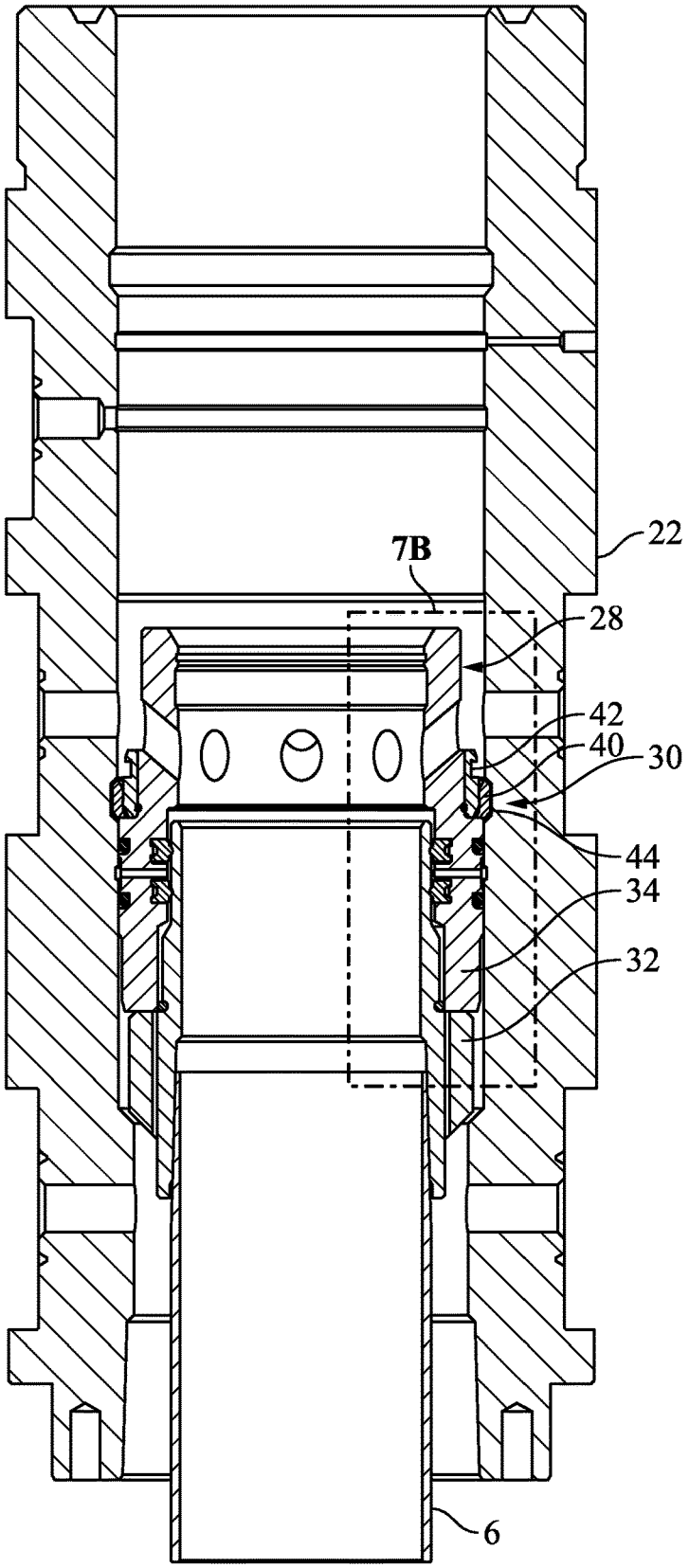
FIG. 7A is a schematic cross sectional view of the tool having the latch system of FIG. 3A that is activated and latched with the tubular member and the casing hanger supported by the tubular member.
Figure 7B:
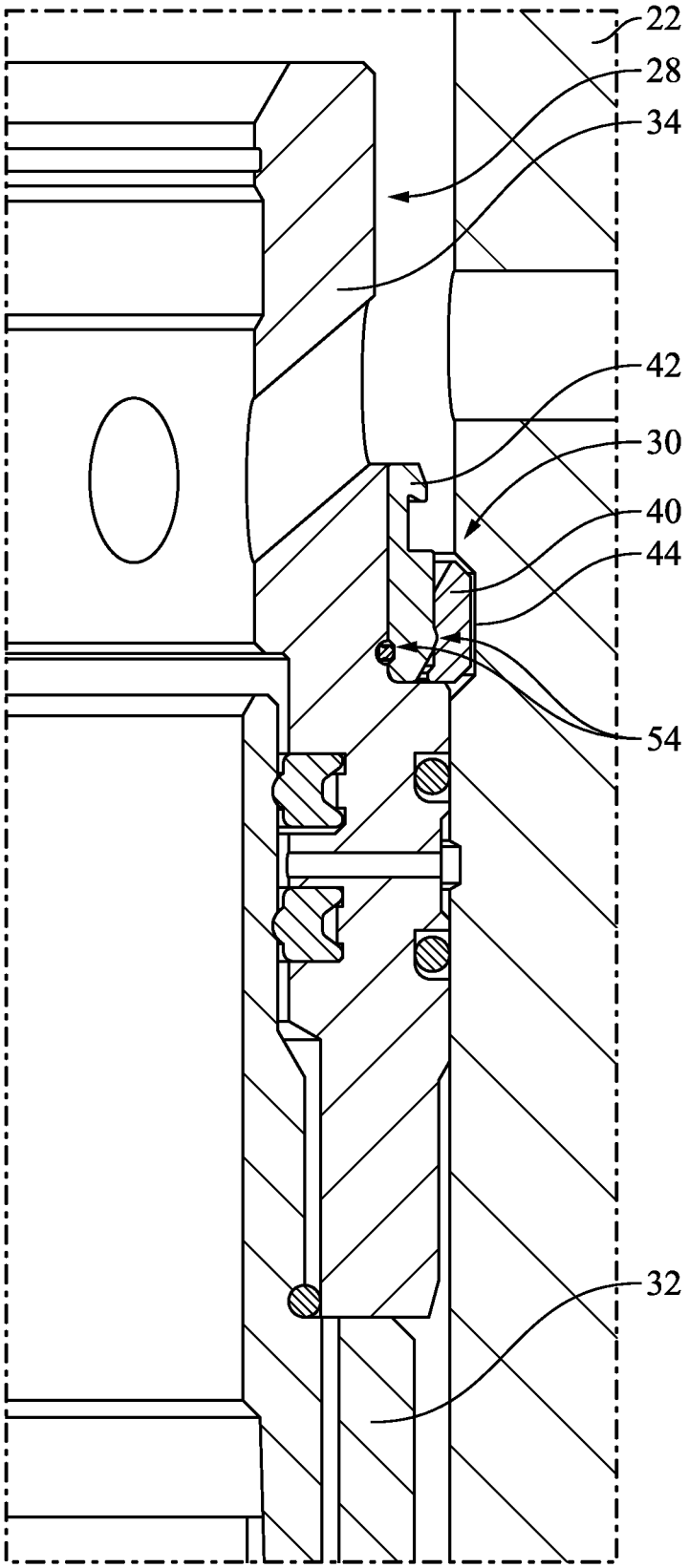
FIG. 7B is a schematic cross sectional view of an enlarged portion of FIG. 7A with the tool having the latch system activated and latched with the tubular member.

FIG. 6 is a schematic cross sectional view of the installation tool coupled with the tool having the latch system of FIG. 3A with the tool and latch system installed at location but prior to activation. FIG. 7A is a schematic cross sectional view of the tool having the latch system of FIG. 3A that is activated and latched with the tubular member and the casing hanger supported by the tubular member. FIG. 7B is a schematic cross sectional view of an enlarged portion of FIG. 7A with the tool having the latch system activated and latched with the tubular member. The assembly shown in FIG. 5 can be inserted into the tubular member 22 and delivered to the intended location. On delivery to the location, the assembly can be pressure tested. The running tool 92 with the adapter 94 can be rotated several turns along the running tool thread 96 to further engage the tool 28 and press the energizing sleeve 42 longitudinally into the lock ring 40, such as by engaging the tapered surfaces shown in FIGS. 3B and 3C. The engagement by the energizing sleeve 42 expands the lock ring 40 radially outward into the tubular member lock groove 44. Concurrently, the energizing sleeve 42 is longitudinally pressed into position between the lock ring 40 and the housing 34 of the tool 28 to engage the self-locking mechanism 54 described above between the energizing sleeve and the lock ring and between the energizing sleeve and the housing. With the lock ring engaged with the tubular member and the self-locking mechanism engaged between the three components, the tool 28 is positively restrained in position at the location. The running tool can be rotated in a reverse direction and removed from the bore of the tubular member, as shown in FIG. 7A.

The tool 28 can be released from the tubular member 22 by reengaging a running tool to the tool and latch assembly. The running tool can include an internal mating hook profile corresponding to the external hook profile 66 of the energizing ring 42. The running tool can engage with the hook profile 66 and pull the energizing ring 42 longitudinally away from the lock ring 40 with sufficient force to disengage the self-locking mechanism 54. With sufficient longitudinal movement of the energizing ring, the lock ring can be allowed to return radially inward to disengage with the tubular member lock groove 44. Once disengaged from the tubular member lock groove 44, the running tool can move the tool 28 to a different location, such as uphole to the surface.

The latch system 30 has been described for use with a tool, such as a pack-off and seal assembly, with the understanding that the latch system can be used with a number of tools of various description and purposes, and so is not limited to the examples described herein. Further, sensors, gauges, and measuring instruments have not been described but are typically used in such tools.

Other and further embodiments utilizing one or more aspects of the inventions described above can be devised without departing from the disclosed invention as defined in the claims. For example, some of the components could be arranged in different locations in the housing, and other variations that are limited only by the scope of the claims.

The invention has been described in the context of preferred and other embodiments, and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope of the following claims.

What is claimed is:

1. An oil field tool configured to be secured inside a tubular member, comprising:

a housing; and a latch system coupled with the housing, comprising:

a lock ring coupled around a periphery of the housing and having an inner self-locking engagement profile on an inside periphery of the lock ring; and an energizing sleeve slidably coupled around the housing and longitudinally displaceable relative to the lock ring and having an outer self-locking engagement profile on an outside periphery of the energizing sleeve configured to engage with the lock ring inner self-locking engagement profile and restrain relative longitudinal movement between the lock ring and energizing sleeve, wherein the self-locking engagement profiles comprise a groove and a protrusion configured to engage the groove to restrain the longitudinal movement between the lock ring and energizing sleeve.

2. The tool of claim 1, wherein the energizing sleeve comprises an inner self-locking engagement profile on an inside periphery of the energizing sleeve configured to engage a compressible member coupled to an outer self-locking engagement profile of the housing to restrain relative longitudinal movement between the energizing sleeve and the housing.

3. The tool of claim 1, wherein the lock ring is radially expandable.

4. The tool of claim 1, wherein the lock ring is formed with splits from at least one of an upper portion and a lower portion of the lock ring through a longitudinal cross-section of the lock ring that is less than a longitudinal length of the lock ring.

5. The tool of claim 4, wherein the splits comprise at least a first split from the upper portion of the lock ring through a first longitudinal cross-section that is less than the longitudinal length of the lock ring and at least a second split from the lower portion of the lock ring through a second longitudinal cross-section that is less than the longitudinal length of the lock ring and is circumferentially and longitudinally offset from the longitudinal portion of the first split.

6. An oil field tool configured to be secured inside a tubular member, comprising:

a housing; and a latch system coupled with the housing, comprising:

a radially expandable lock ring coupled around a periphery of the housing and formed with splits through a longitudinal cross-section that is less than a longitudinal length of the ring; and an energizing sleeve slidably coupled around the housing and longitudinally displaceable relative to the lock ring;

wherein the splits comprise at least a first split that is formed through the longitudinal cross-section in a longitudinal direction from a top edge of the lock ring and at least a second split offset from the first split that is formed through another longitudinal cross-section in another longitudinal direction from a bottom edge of the lock ring.

7. The tool of claim 6, further comprising the lock ring having an inner self-locking engagement profile on an inside periphery of the lock ring.

8. The tool of claim 7, further comprising the energizing sleeve having an outer self-locking engagement profile on an outside periphery of the energizing sleeve configured to engage with the lock ring inner self-locking engagement profile and restrain relative longitudinal movement between the lock ring and energizing sleeve.

* * * * *